US005515266A

United States Patent [19]

Meyer

[11] Patent Number: 5,515,266

[45] Date of Patent: May 7, 1996

[54] TEXTILE SPINNING MACHINE MANAGEMENT SYSTEM

[76] Inventor: Urs Meyer, Hohfurristrasse 1, CH-8172 Niederglatt, Switzerland

[21] Appl. No.: 134,932

[22] Filed: Oct. 12, 1993

Related U.S. Application Data

[63] Continuation-in-part of Ser. No. 927,307, Nov. 20, 1992, and a continuation-in-part of Ser. No. 852,153, May 28, 1992, abandoned.

[30] Foreign Application Priority Data

Oct. 12, 1992 [CH] Switzerland ..... 03183/92

[51] Int. Cl.[6] ..... G05B 9/02

[52] U.S. Cl. ..... 364/184; 364/470; 57/264

[58] Field of Search ..... 364/470, 184–188; 57/264, 265, 263; 19/90, 105; 28/185, 241, 248; 395/902, 903, 904, 906, 912, 914; 377/16

[56] References Cited

U.S. PATENT DOCUMENTS

| | | | |
|---|---|---|---|
| 4,534,042 | 8/1985 | Marsicek et al. | 377/16 |
| 4,660,365 | 4/1987 | Raasch | 57/264 |
| 4,835,699 | 5/1989 | Mallard | 364/470 |
| 4,843,808 | 7/1989 | Ruge et al. | 57/264 |
| 4,876,769 | 10/1989 | Schlopfer et al. | 19/105 |
| 4,916,625 | 4/1990 | Davidson et al. | 364/470 |
| 4,928,353 | 5/1990 | Demuth et al. | 19/105 |
| 4,940,367 | 7/1990 | Staheli et al. | 19/105 |
| 5,046,013 | 9/1991 | Ueda et al. | 364/470 |
| 5,161,111 | 11/1992 | Oehler et al. | 364/470 |
| 5,229,988 | 7/1993 | Barea | 364/470 |

FOREIGN PATENT DOCUMENTS

| | | |
|---|---|---|
| 0410429A1 | 1/1991 | European Pat. Off. . |
| 0426979A2 | 5/1991 | European Pat. Off. . |
| 4031419A1 | 4/1991 | Germany . |
| 4137742A1 | 5/1992 | Germany . |

*Primary Examiner*—James P. Trammell

[57] ABSTRACT

A machine-management system for a spinning machine comprising a data acquisition file in which selected components of the machine are listed and the instantaneous condition for each selected component is stored in the file.

21 Claims, 10 Drawing Sheets

SCREEN
30
RAM-MEMORY
34
MAIN STORAGE
36
CENTRAL PROCESSOR
32
INTERFACE
42
38
HARD DRIVE
DIAGNOSIS MODULE
26
COMPUTER
24
STRESS-FUNCTION FILE
22
LIST FILE
20
ANALYSIS MODULE
28
REPAIR-SUPPORT FILE
40

TEXTILE SPINNING MACHINE MANAGEMENT SYSTEM

CROSS-REFERENCE TO RELATED APPLICATIONS

This is a continuation-in-part of U.S. patent application Ser. No. 07/927,307 filed Nov. 20, 1992 for Process Control In The Textile Plant and a continuation-in-part of U.S. patent application Ser. No. 07/852,153 filed May 28, 1992 now abandoned for Processes For Finding The Material Flow In A Textile Processing Plant, the disclosures of which are incorporated herein by reference.

BACKGROUND OF THE INVENTION

The present invention relates to a machine-management system for textile spinning installations and more particularly to a system for monitoring the condition of preselected component portions of a spinning machine and managing operation of the machine according to the monitored condition.

State of the Art/Related Applications

A system of the type described herein is outlined in DOS 4 137 742. This DOS system deals with the acquisition of data that can be comprised in a file and can be analyzed statistically in order to improve planning in connection with maintenance work. According to the DOS this file is to be put together from data that are collected by the maintenance team during maintenance work.

The method intended according to this DOS certainly is sensible. The file created in it however only takes into account a fraction of the information which is available, and the evaluation of this file for the operation support is not described but merely mentioned in the DOS. The DOS therefore seems to contain merely the reallocation of an activity, which is presently done in a well-managed spinning mill with paper and pencil, to the use of a portable computer.

According to DOS 4031419 data are collected during the maintenance works.

The present invention includes the creation of a file as an important element of the management system. The file may include certain data which may be collected according to DOS 4 137 742. A file created according to the present invention includes much more, however, and also includes the use of software (programs) which can use the collected data for operation support.

The present invention in certain aspects represents an invention a further development of the subject matter described in the following patent applications, the disclosures of which are incorporated here by reference.

a) PCT-patent application WO 91/16481 b) DE-patent application no. 41 31 247 c) CH-patent application no. 3272/91 d) EP-patent application no. 92107474.6

SUMMARY OF THE INVENTION

According to this invention for at least one and preferably every important portion, component or subassembly of a spinning machine the condition of such portion(s) is stored as data in a file. Such data are brought up to date at least intermittently, preferably at least periodically, and most preferably continuously or quasi-continuously via a calculation program which takes into consideration a preset stress function and the applicable operating conditions. This stress function can be prescribed by the manufacturer of the component and/or of the machine. Initial approaches for such functions are described in e.g. DE-41 31 247 and in DE-39 37 439 (Zinser). The operating conditions can be taken, e.g., from a system according to our EP application 92 107 474.6. But the effective operating conditions are preferably not only determined according to this disclosure but also according to an "expanded" sensory mechanism according to the disclosure of CH 3272/91.

According to the preferred embodiments of the invention the content of the file created is accessible to analysis or diagnosis programs which are used for operation support. The results of the analyses or diagnoses can be made available to the operating staff by means of a system according to WO 91/16481 (obj. 2093).

The diagnostic means (e.g. in the form of a program) serves for the determination of the machine component or subassembly in question when a malfunction is detected. With the application of a suited sensory mechanism a malfunction can be forecast prior to the "catastrophic" appearance of a defect in order that after determining the malfunction there is still some time left to take appropriate corrective measures before the affected machine component is no longer employable.

The analytical means (e.g. in the form of a program) can be designed for the determination of maintenance needs and the transmission of corresponding information to a maintenance team. A suitable means is shown e.g. in the U.S. Pat. No. 4,916,625, the disclosure of which is incorporated by reference.

An interface can be provided which enables communication with a spare part management system in order that decisions concerning the spare part provision as well as decisions concerning maintenance measures can be made based on the spare part inventory or need.

In terms of hardware the new system can be realized in various embodiments. In one embodiment the new file, a stress calculator connected to the file and a diagnostic or analytical mechanism also connected to the file are provided in a portable computer.

In another embodiment the new file and the stress calculator are provided in a machine control, mechanism where the means of diagnosis or analysis is provided in the machine control mechanism or in portable devices.

In the solution (which will then be preferred where the possibilities for its realization are given), the new file, the stress calculator as well as the analysis or diagnosis means are integrated in a control mechanism superior to the machine, e.g., in a master process control computer.

The diagnosis or analysis mechanism can be designed as expert systems.

The sensory mechanisms of the machine can be connected with an evaluation mechanism which transmits signals to the new system.

BRIEF DESCRIPTION OF THE DRAWINGS

Exemplary embodiments of the invention are explained in detail below with reference to the accompanying figures wherein.

DETAILED DESCRIPTION OF EXEMPLARY EMBODIMENTS

Operation Support

Figure 1:
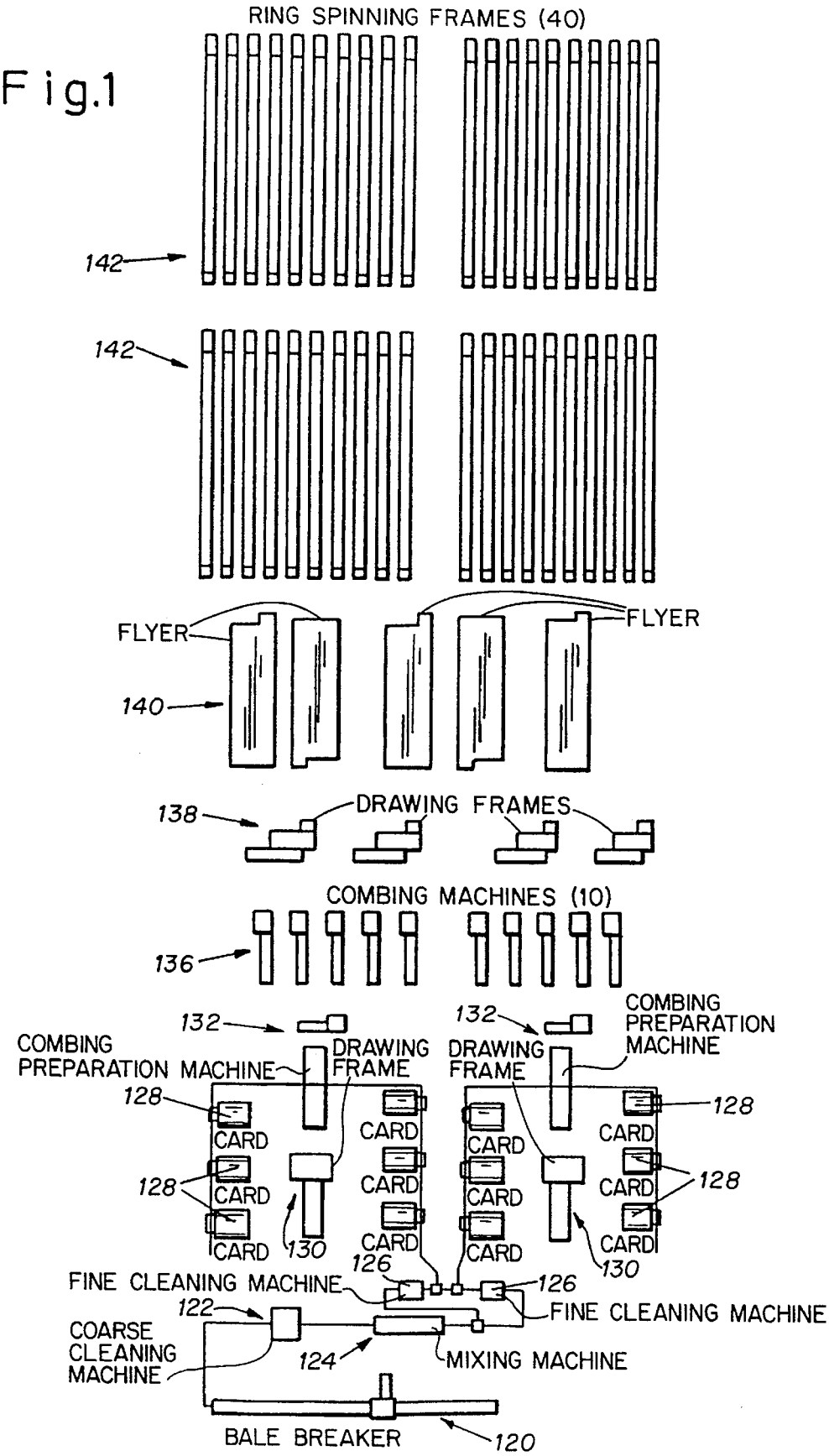
FIG. 1 is a schematic of a layout an entire spinning mill corresponding to FIG. 6 of our PCT patent application WO 92/13121.

The spinning mill shown in FIG. 1 comprises a bale breaker 120, a coarse cleaning machine 122, a mixing machine 124, two fine cleaning machines 126, twelve cards 128, two drawing frames 130 (first drawing passage), two combing preparation machines 132, ten combing machines 136, four drawing frames 138 (second drawing passage), five flyers 140 and forty ring spinning frames 142. Each ring spinning frame 142 comprises a plurality of spinning positions (e.g., up to about 1,200 spinning positions per machine).

FIG. 1 shows a conventional spinning mill arrangement for the production of a so-called combed ring-spun yarn. The ring spinning method can be replaced by a more modern spinning method (e.g. rotor spinning), where a flyer is not needed. Given that the principles of this invention are applicable independent of the type of final spinning stage, the following description referring to conventional ring spinning applies equally to application of the invention in connection with new spinning methods. Not shown in FIG. 1 is the winding system used in connection with ring spinning machines which is not employed in new spinning methods (e.g. rotor spinning).

The operation of an installation as shown in FIG. 1 represents an extremely complex organizational or planning task for the spinning mill management which is further complicated by ever increasing requirements concerning spun yarn quality and production together with an ever increasing pressure to reduce production costs.

Figure 2:
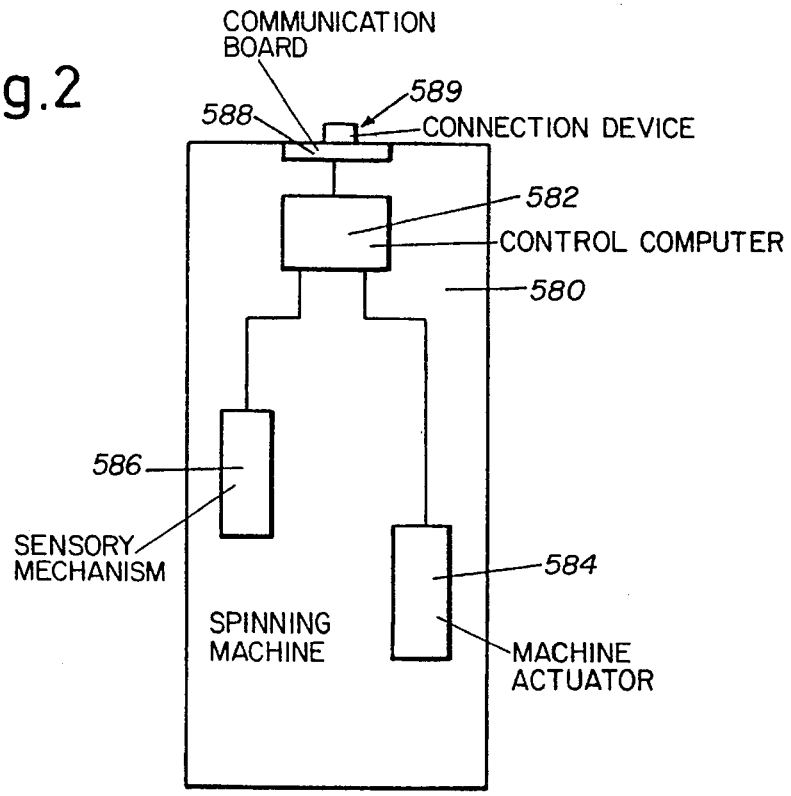
FIG. 2 is a diagrammatic representation of the "communication-capable" machine corresponding to FIG. 22 of WO 92/13121.

The Communication-Capable Machine:

FIG. 2 shows diagrammatically a spinning machine 580 with its own control 582, which controls the machine actuator mechanism 584 and receives messages (signals, data) from the sensory mechanisms of the machine 586. This control mechanism 582 is in the form of a computer with appropriate programs (software). The machine 580 is provided with a "communication board" 588 which is connected to the control mechanism 582 and has a connection device 589 which serve for connecting the board 588 with a communication line. The connection device can be designed for connection with a coaxial cable or fiber-optic light guide or with a twisted double wire, for example.

The communication board 588 preferably includes data storage means or memory for serving as buffer storage for the supplied data or for the data to be transmitted. This buffer storage is preferably "over-dimensioned" as compared to normal operation, and it may therefore store accruing data over a predetermined period. The communication board 588 may include drivers (programs). The board 588 includes data from the storage memory to data packages which can be transmitted via the line.

In a preferred embodiment, the communication board 588 and the machine control 582 are adapted to each other by the machine manufacturer and are prepared for communication connection with an external system. It is thus necessary to arrange a suitable protocol (transaction mode) and a common "object list" with the data acquisition and processing equipment supplier, the latter list defining the information inputs of the signals. Thus an external digital system and the machine control 582 are mutually capable of communication.

The Sensory Mechanisms of the Machine

Figure 3:
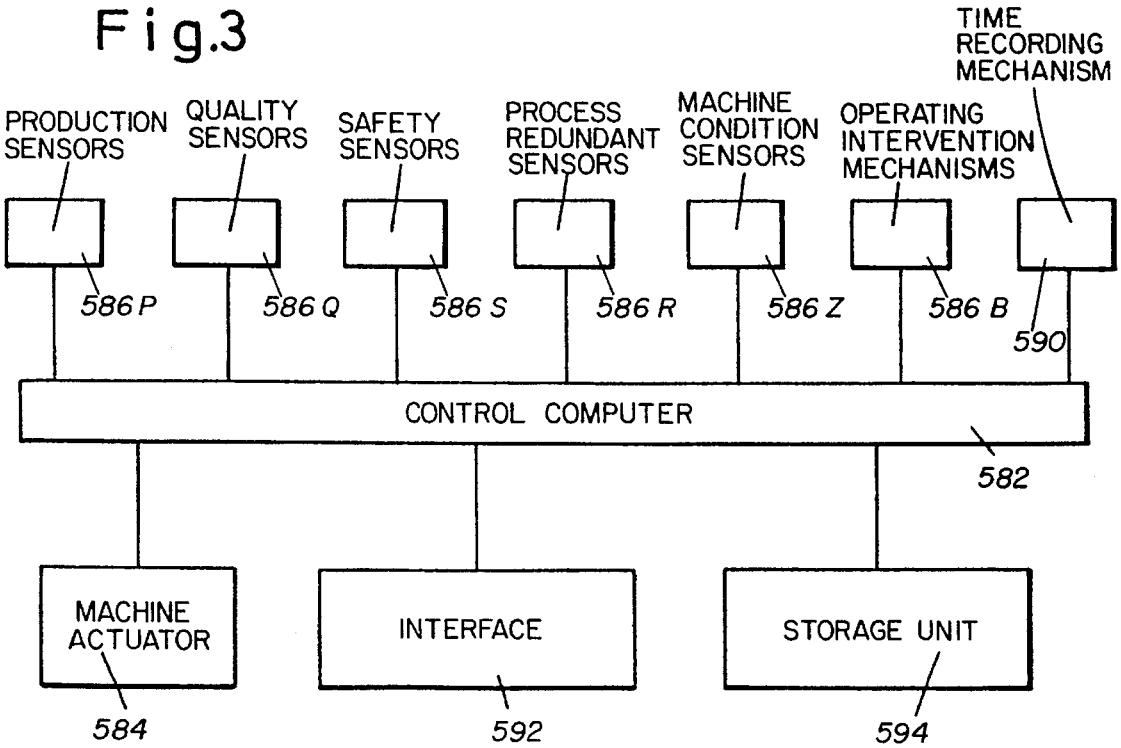
FIG. 3 shows a diagrammatic representation of a spinning machine with an "expanded" sensory mechanism, e.g., according to CH-patent application no. 3272/91 showing a sensory mechanism which supplies signals that are generated not merely to meet the basic function of the machine.

FIG. 3 again shows the machine control 582, which controls the actuator mechanism 584 of the machine, as described for example in WO 92/1314 in connection with a ring spinning machine. The control 582 in FIG. 3 is shown with the sensory mechanisms 586P-Z connected to the machine control computer 582, the sensor designation being "sensory groups", where each individual group of sensors 586P-Z is allocated to a predetermined task. The following individual groups are shown in FIG. 3 and described below, however, not all groups may be provided in every given application:

i) Production sensors 586P—these sensors sense to the throughput of textile material, and influence the material flow in the feed and delivery; such sensors are present in every modern spinning installation. Examples can be found in the disclosures of the following patent documents: US-4,715,550; DE-41 407; JP-OS-3/33433.

ii) Quality sensors 586Q—respond to the quality of the textile material product of the machine; such sensors are increasingly employed. Examples can be found in the disclosure of the following patent documents: EP-436 204; EP-156 153; DOS-4 113 384; EP-410 429.

iii) Safety sensors 568S—respond to conditions which may lead to damage (person, machine or unit damage). Such sensors can be found in every modern spinning mill, e.g., in gate switches, access monitoring, short circuiting switches, etc. Examples may be found in the disclosure of the following patent documents: DE-39 12 737; DE-30 34 589; EP-353 784.

iv) Process redundant sensors 586R as described in CH-3273/91, respond to conditions which, if needed, exert an influence on the results of the method, but the fiber treating is not directly controlled according to the output signals of these sensors. Examples are air conditioning sensors.

v) Machine condition sensors 586Z—respond to the mechanical condition of the machine. Such sensors are not widely in use today in spinning installations. Examples are sensors that monitor the power consumption of motors or of the entire machine, or the vibrations or temperatures at suited places in the machine. Examples can be found in the following patent documents: JP-AS-2-38689; WO 85/-49-8; JP-OS-3-824.

vi) Operating intervention mechanisms 586B—relay such interventions to the machine control. Such interventions can be effected by an operating person or by an operating device (e.g. by a piecing robot). Examples of such sensors can be found in the disclosure of the following patent documents: U.S. Pat. No. 4,005,392; DOS-24 54 721; DOS-3 701 796.

FIG. 3 also shows diagrammatically a time recording mechanism 590 which enables the log-book like storing of data or events which enables a subsequent inspection of the data to determine chronological correlations. Such a concept is described in DE-40 24 307 (corresponding to co-pending U.S. application Ser. No. 07/852,153, filed May 28, 1992) now abandoned relating to material flow, and for other purposes in Swiss patent application no. 2783/92 the disclosure of which is incorporated herein by reference.

The system shown in FIG. 3 is also provided with an interface 592 which provides man-machine communication. Normally, this is designed for bidirectional communication and comprises a keyboard for entering signals into the control, for example. Typically, however, output communication is of greater importance and can be effected, e.g., by means of a screen. A suitable operating surface for this purpose has been shown in "Textile World", April 1991, page 44 pp. (G5/2 Ring spinning machine).

The output signals of the sensors are analyzed or processed in the machine control mechanism 582, and the results of the evaluation are stored in a file in a storage unit 594 of the control computer 582. This file of information or data (the storage) accumulates and contains current values of the output signals from the sensors as well as data which represents a chronological sequence of these accumulated values over a preset interval (in order to allow the operator to be able to recognize gradually developing deviations). The file also contains deviations outside of the preset tolerance limits as well as data concerning operation interventions. Suitable evaluations are described in EP-365 901 and 415 222.

Figure 4:
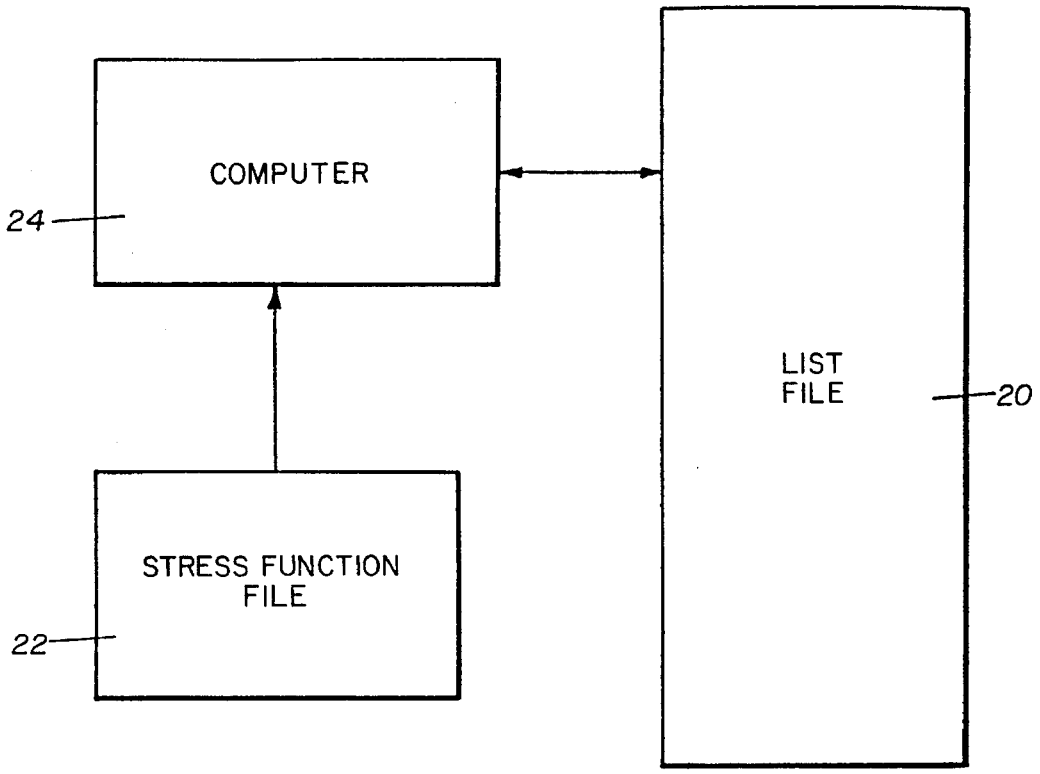
FIG. 4 is a diagrammatic representation of the basic elements of a system according to this invention.

FIG. 4 shows three basic elements of a system according to this invention, which are:

a) a file (a storage) 20 which contains a "list" of selected components of the machine, here the current operating condition of each machine component is stored. The stored data represent the operating capability of a component, e.g., as "acceptable", "questionable", "defect".

b) a file (a storage) 22 which contains a "stress function" for each component of the previously mentioned list. This function sets up a relation for the affected component between the change of condition to be expected and the prevailing operating conditions. Examples for simple stress functions are listed in DOS-39 39 439 (Zinser) and in our German patent application, no. 41 37 247.

c) a computer 24 which, based on the data concerning the initial state of a component and the prevailing operating conditions, can obtain the corresponding stress function from the file in order to effect extrapolations concerning changes in condition. The results of such extrapolations can be read out as "estimates" (without influencing the data stored in the file) and/or they can be entered as an actual new condition in the file in which case they present a new initial position for further extrapolations.

The listed contents of the file 20 can be expanded, as discussed below in connection with more complex examples. One particularly advantageous expansion, for example is that the file may be supplemented with data concerning the actual longevity of each employed component, which enables a comparison of the extrapolated and the actually reached value.

Figure 5:
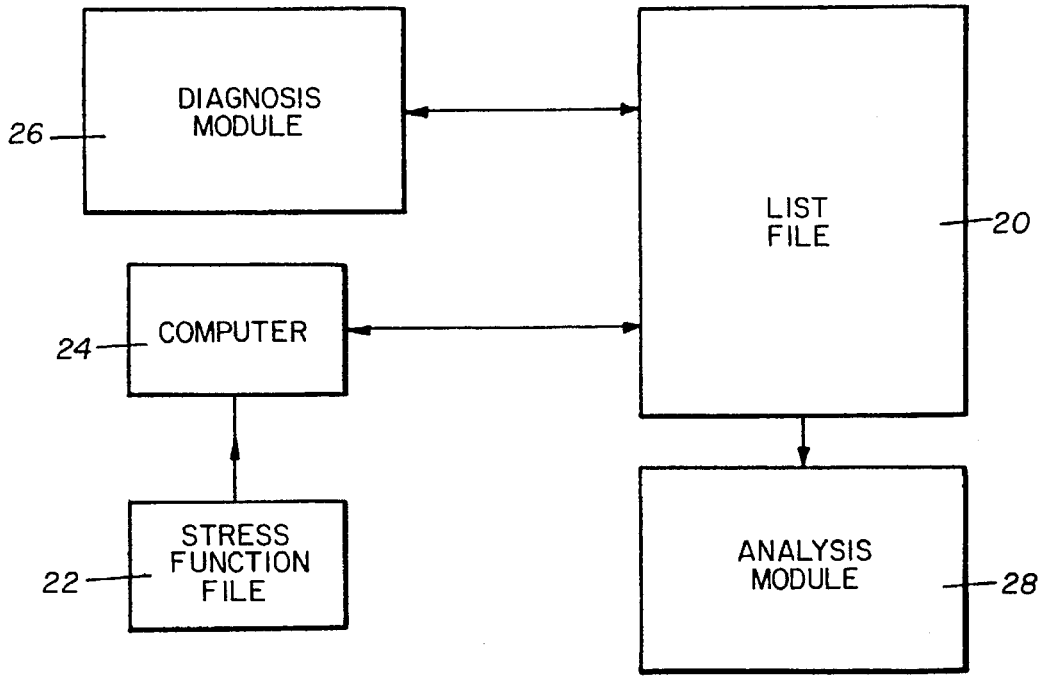
FIG. 5 is a schematic representation of elements similar to those shown in FIG. 4 together with additional modules which effect operation support based on the data offered by the basic elements.

FIG. 5 shows two advantageous expansions of the elements FIG. 4, with each of these expansions being able to be employed by itself (i.e. independent from each other). The most important expansions comprise:

on the one hand, a diagnosis module 26 which can investigate possible malfunctions in the machine concerning their causes. The diagnosis can be effected based on stored data of condition, it may however also lead to changes in the stored condition data in order that a bidirectional connection between this module and the file 20 is advantageous. The diagnosis module 26 can be designed as an expert system, e.g., according to the system that is offered under the name "Mainrex" by the company Frametec.

on the other hand an analysis module 28, which determines the maintenance needs of the machine based on the data and details concerning the existing operating conditions stored in the file 20. The analysis module 28 can be integrated together with the stress calculator 24. Advantageously, however, it is also designed standardized as an expert system and hence as an independent module with access to file 20. The principles of such a system are described in U.S. Pat. No. 4,916,625.

Additional expansions of the above-mentioned data which are present in file 20 preferably include the following details for each component included on the component list:

1. the chronological urgency for an intervention in case of a defect or with preset conditions,
2. the type of and the expenditure for the intervention.
3. a "priority" for the intervention or, possibly, an "amount of damage" in case of a "non-intervention".

Such data are preferably stored in file 20 in direct connection with the listed components. Hence, they are available to both modules 26, 28. But obviously they can also be integrated into the modules directly as well.

Devices

The described variants of data compilation and manipulation can be installed in the machine control 582 as programs. The computing capacity for the stress calculation or for operating the expert systems is typically provided in a minicomputer which is employed as machine control 582. files 20, 22 can be structured or administered in the memories or storages allocated to the computer 582.

It is however not sensible to burden the computing or storage capacity of the machine control 582 with these functions. On the one hand such capacity is normally almost at full capacity with the accomplishment of the control tasks. On the other it would require for each machine its own set of the pertaining functions, even though, these functions would be employed only erratically.

It would be more sensible to provide at least the malfunction diagnosis module 26 in a portable device that can be relocated from machine to machine and that can be employed when needed. The device is preferably transported by a maintenance team. Such a device is typically a "notebook" computer for example as mentioned in DOS 4,537,742.

Figure 6:
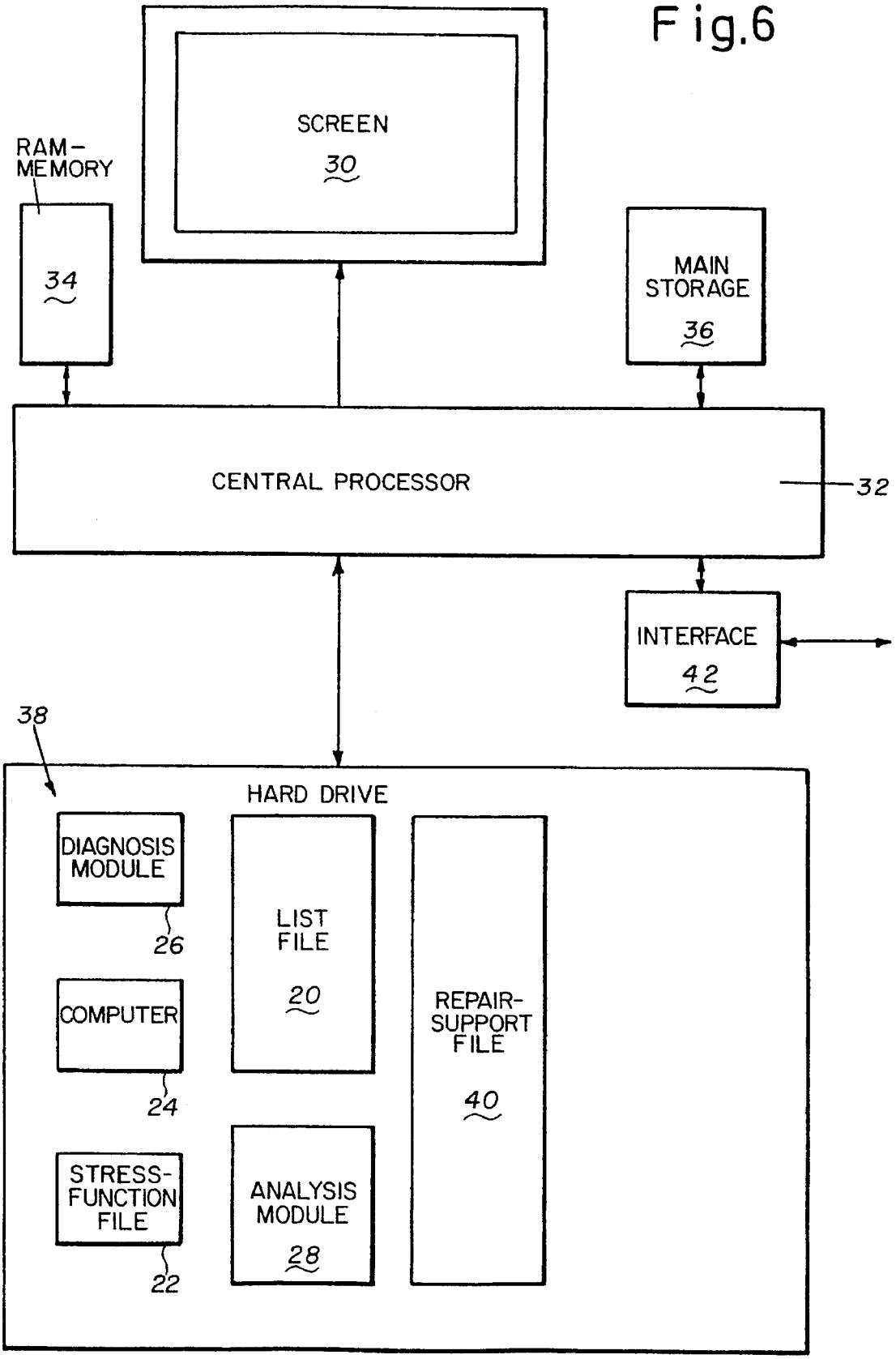
FIG. 6 shows diagrammatically a portable device for realizing a system according to FIG. 5 in cooperation with a machine according to the system of FIG. 2.

FIG. 6 shows diagrammatically a preferred variant of such a portable device that is equipped with a screen 30, a central processor unit 32, a hard drive 38, a RAM-memory 34 as well as main storage 36. The device is programmed with an operating system that is suited for operating the following applications. The application consists of the modules of FIG. 5, as well as an additional file 40, which includes, for example, "repair-support" functions and is subordinated to the maintenance module. File 40 contains, e.g., repair instructions and details concerning the availability of necessary spare parts as well as, possibly, preset times for the corresponding service. Such details are available for planning the necessary works.

The portable device of FIG. 6 must be arranged for communication with the machine via an interface 42. As shown in FIG. 2, this is no major problem for a modern machine. A suitable communication protocol must be laid down in order for the information stored in file 594, FIG. 3, to be transmitted via interface 588, 589, FIG. 2, to the portable device, FIG. 6, once the device has been connected to the machine via a line and a plug connector. Operation support takes place via screen 30 of the portable device. Via the same communication connection 42 the portable device can be connected with a file (not shown) that contains master data concerning the availability of spare parts. This feature will be discussed in greater detail based on the following embodiment.

Figure 7:
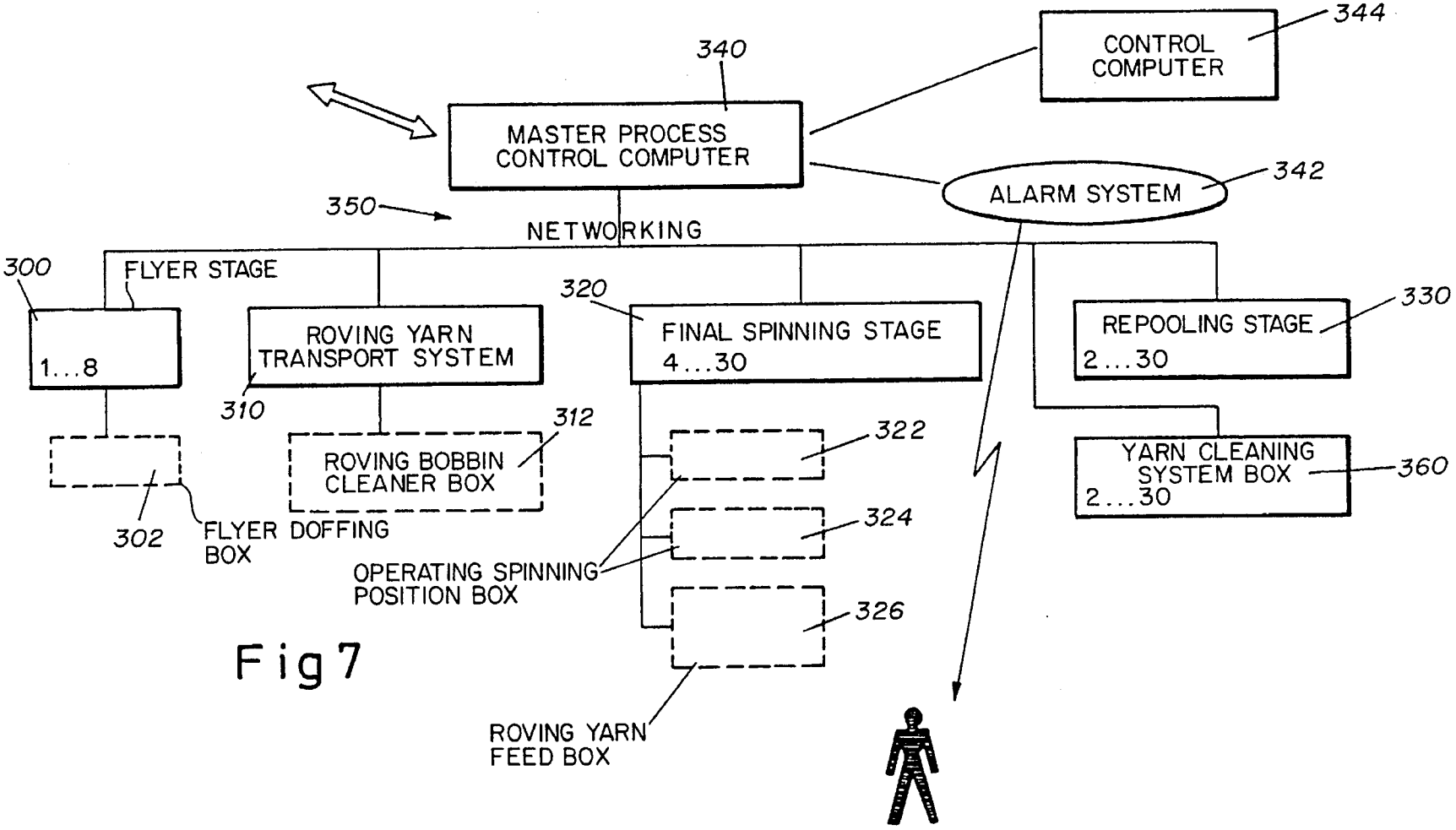
FIG. 7 is a schematic overview of a system corresponding to FIG. 7 of PCT patent application no WO 91/16481.
Figure 8:
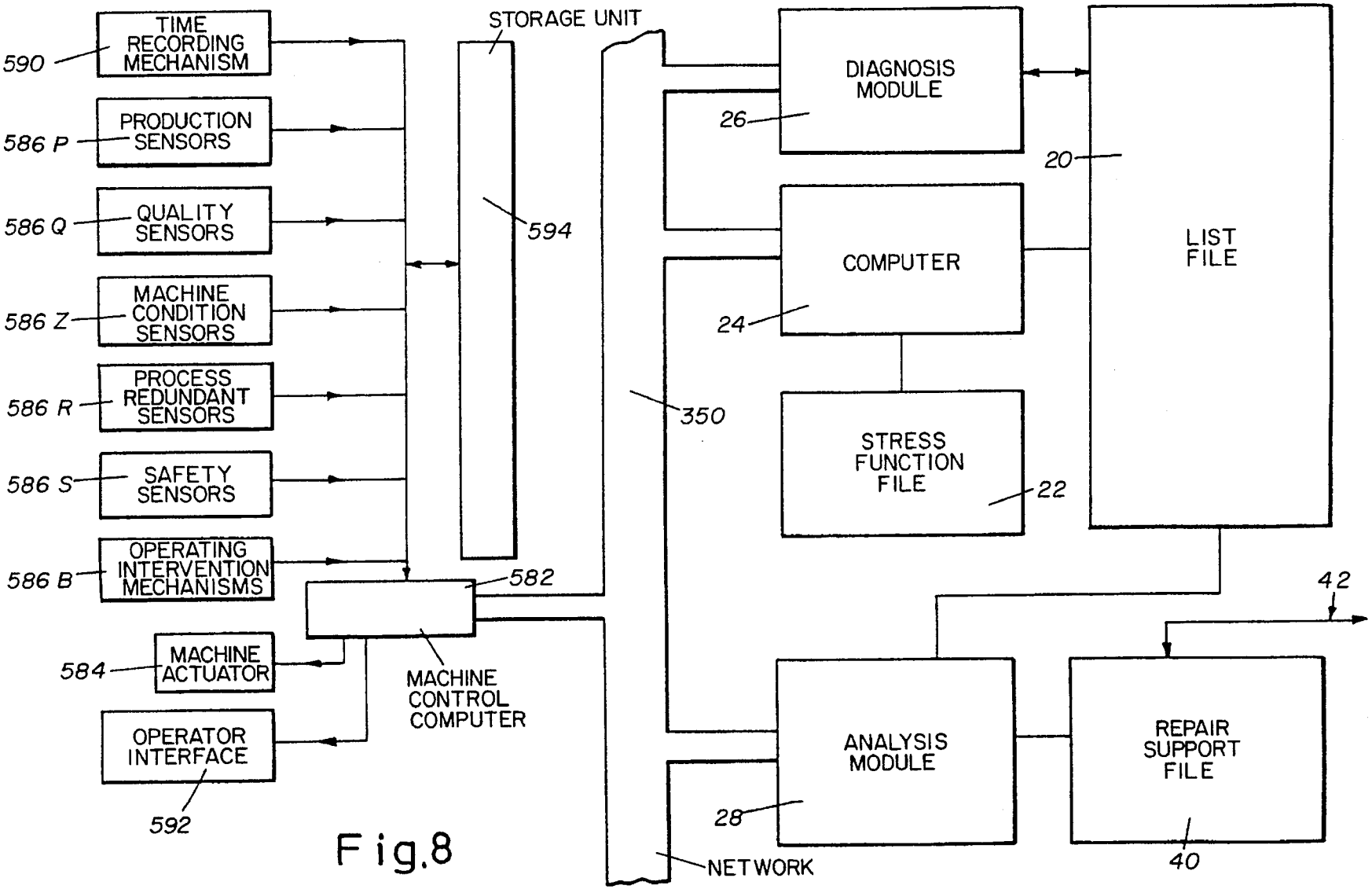
FIG. 8 is a diagrammatic representation of a system according to the invention which can be realized in an operation support system according to the system of FIG. 7; and, FIGS. 9*a, b* and 10*a, b* show a system according to the system of FIG. 8 in various working modes.

FIG. 8 shows a system which is based on the communication between the machine control 582 and a process control computer, e.g., as described in WO 92/13121. Operation support is preferably performed via the operator interface of the corresponding machine (as described in WO 91/16481). FIG. 7 shows system as shown in FIG. 7 of said application to explain the communication connection.

The plant portion shown in FIG. 7 comprises (in the order of process stages, i.e., the "linkage" of the machines):

a) the flyer stage 300 b) a final spinning stage 320, in this case formed by ring spinning machines, c) a roving yarn transport system 310 to carry speed frame bobbins from the flyer stage 300 to the final spinning stage 320 and empty tubes from the final spinning stage 320 back to the flyer stage 300, and d) a respooling stage 330 in order to transform the cops of spun yarn formed at the ring spinning machines into bigger (cylindrical or conical) yarn packages.

Each processing stage 300, 320, 330 comprises a number of main work units (machines), each being equipped with its own control computer. Such controls are not shown in FIG. 7, but it will be explained in greater detail below. Connected to each machine control computer are robotics units (automatic operating devices) which are allocated directly to that an individual machine. In FIG. 7 for each flyer of the stage 300 a doffing apparatus is provided—the function of the "flyer doffing" is represented in FIG. 7 by box 302.

An exemplary possible embodiment is described, for example, in EP-360 149 or in DE-OS- 3 702 265.

In FIG. 7, for each ring spinning machine of stage 320, an automatic operating device or robot is provided for each row of spinning positions to operate the spinning positions, and a creeling operating device for the roving yarn feed. The function "operating spinning position" is represented by boxes 322, 324 (a box for each row of spinning positions) and the function "roving yarn feed" by box 326. An exemplary embodiment is described more fully in EP-394 708 and 392 482.

The roving yarn transport system 310 is also equipped with its own control device which is not discussed in detail here. The system 310 comprises a unit for cleaning the roving bobbins before they are returned to flyer stage 300. In FIG. 7 the function "roving bobbin cleaner" is represented by box 312. An exemplary embodiment of this portion of the installation is described in part in EP-392482.

The ring spinning machine of stage 320 and the bobbin winding machines of stage 330 together form the "machine compound" by which transport of the cops to the bobbin machines is ensured. Control of this compound takes place by the bobbin machine.

A networking 350 is provided by which all machines of stages 300, 320, 330 and the system 310 are connected to a master process control computer 340 for signal exchange (data transmission). The computer 340 serves directly an alarm system 342 and a control 344, e.g., in a control station or in a master office.

An important function of the rewinding of ring-spun yarn is carried out by the yarn cleaning system represented by box 360. The yarn cleaner 360 is connected with the master process control computer 340 via networking 350. With this device, yarn defects are eliminated and simultaneously information (data) collected which enable the operator to make conclusions concerning the previous process stages. The yarn cleaning function is effected at the bobbin machine 330.

Each machine is also equipped with an "operator interface," 592, FIG. 3, which is connected to a corresponding control computer and enables a person-machine (or even robot-machine) communication. The "operator interface" can also be called "operator control panel". An example of such an operator interface is described in DE-OS 37 34 277, however, not for a ring spinning machine but for a drawing frame. The principle is the same for all such control means.

According to an aspect of the invention, as described in WO 91/16481, the system is programmed and designed in such a manner that the process control computer 340 can effect operation support via the operator interface 592 of the corresponding machine, i.e., a master process control computer 340 can transmit control commands via the networking 350, and the individual machine control computers can receive and execute these control orders in order that the condition of the operator interface 592 is implemented by the process control computer 340 via corresponding individual machine control computers.

A machine can also be provided with more than one "operator interface". Here it is important that the operator interface, or each operator interface, is connected to an individual machine control computer in order that signals between the operator interface and a machine control computer can be exchanged. When e.g. an auxiliary device is provided at a machine with its own operator interface, but the device is subordinated to a machine control computer, the operator interface of the device is subordinated to the machine control, the operator interface of the device is to be allocated to the machine.

FIG. 8 shows the above mentioned files, and modules, in combination with a machine control computer 582, so here the files and modules are integrated into the master process control computer 340, FIG. 7. This computer 340 also has an interface 42 with a computer (not shown) which controls the spare part management and/or is stored with data concerning the availability of spare parts. A diagnosis or an analysis of the module 26 or 28 is done at a respective machine via its operator interface 592, where the maintenance person (or team) is called by the process control computer 340 via a calling system described, for example, in PCT-WO91/16381 at this machine. Via operator interface 592 communication between the staff and the process control computer 340 can take place. The staff may also be equipped, if necessary, with portable devices (FIG. 6) which can also communicate with the process control computer 340 via the networking 350 which possibly is even enabled by the "unloading" determined module from the control computer 340 to the device.

Figure 9A:
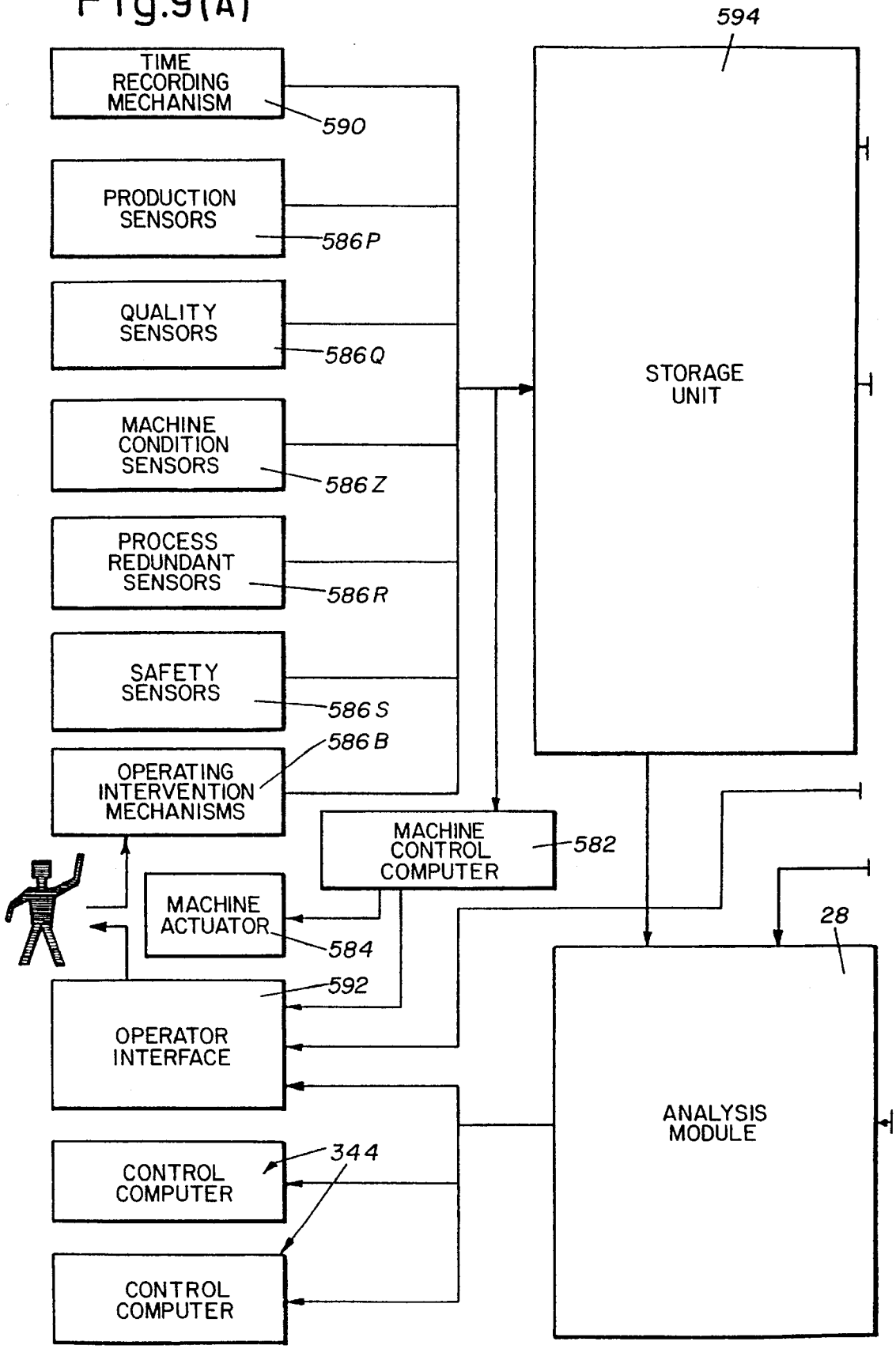
Figure 9B:
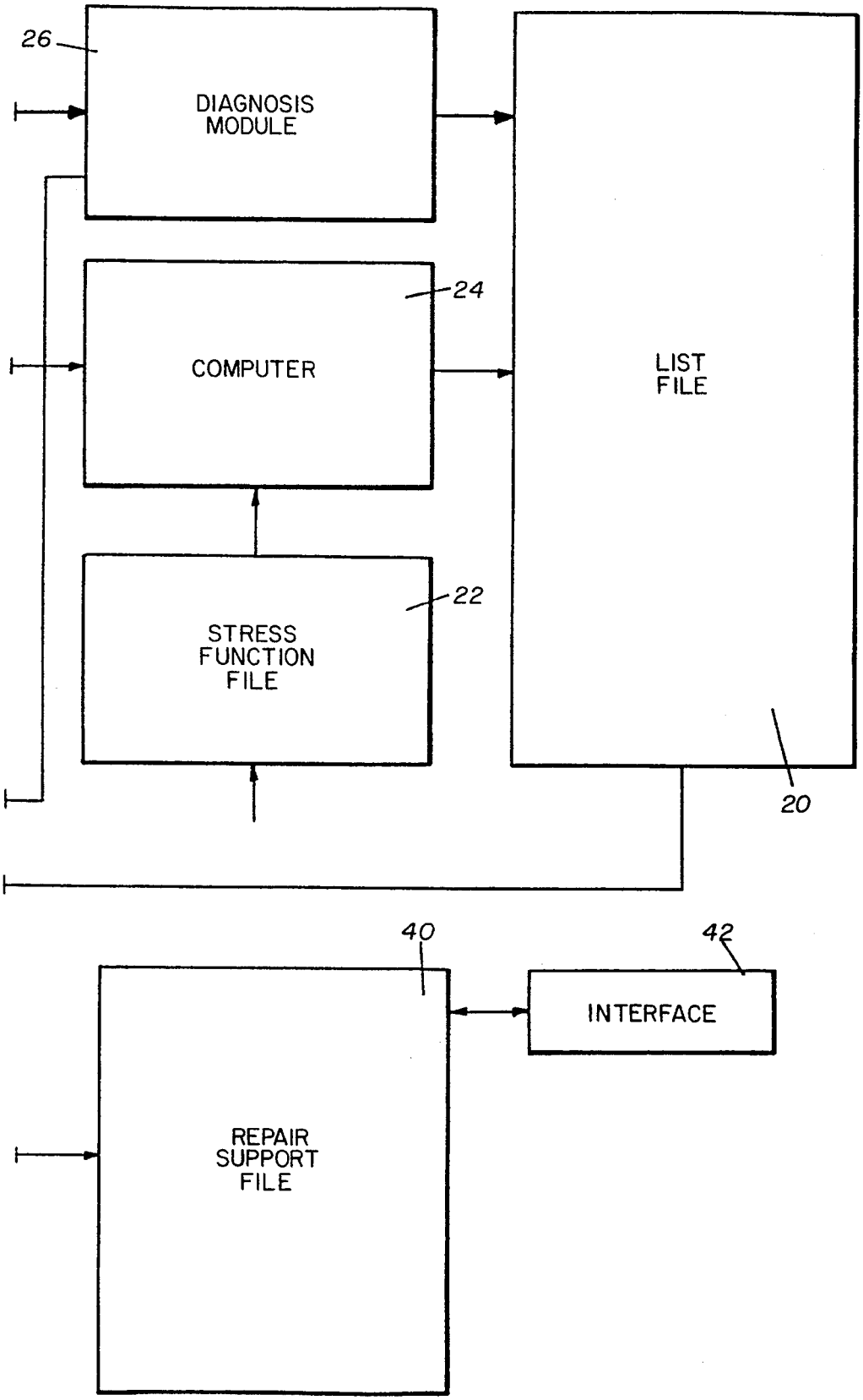
Figure 10A:
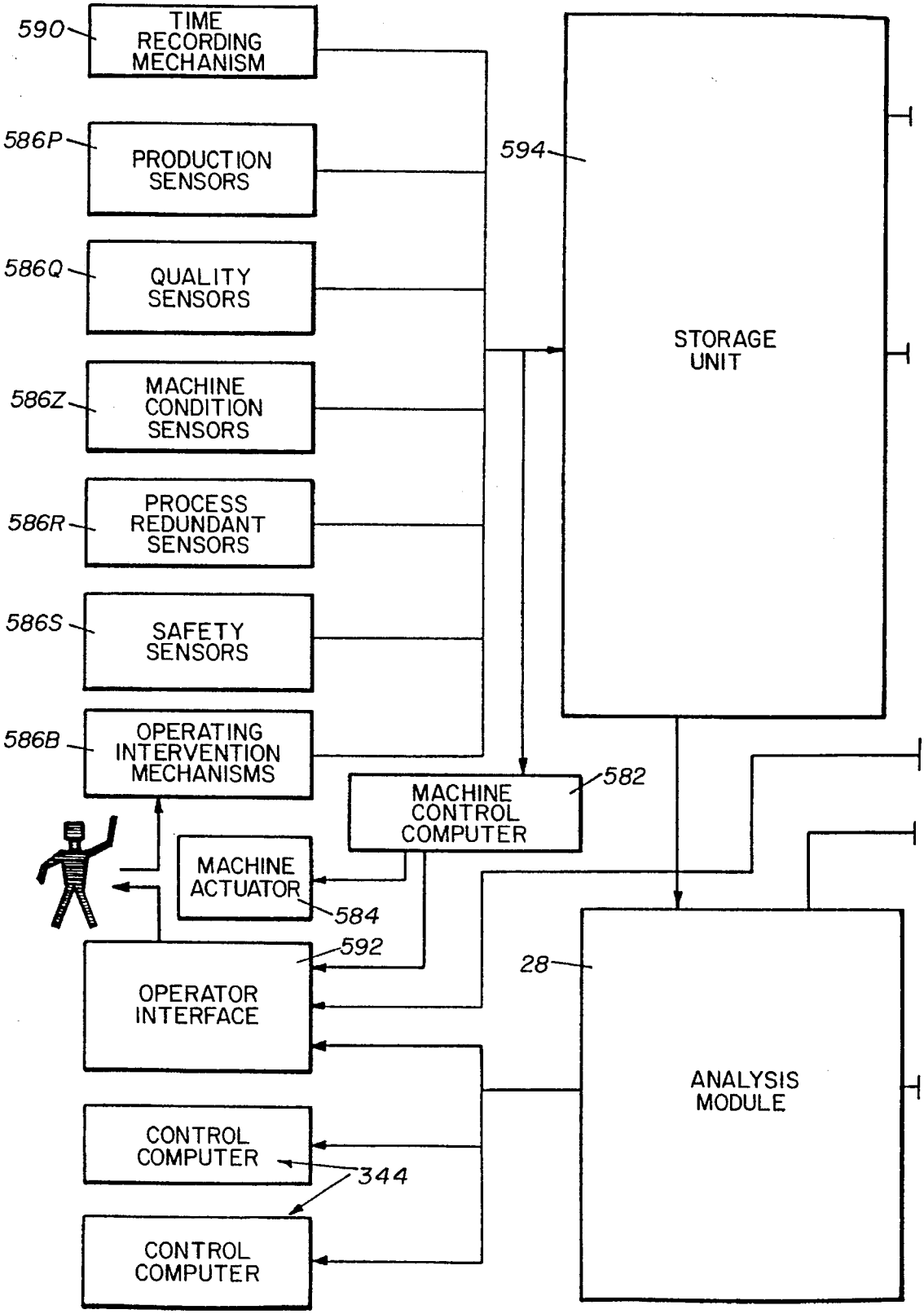
Figure 10B:
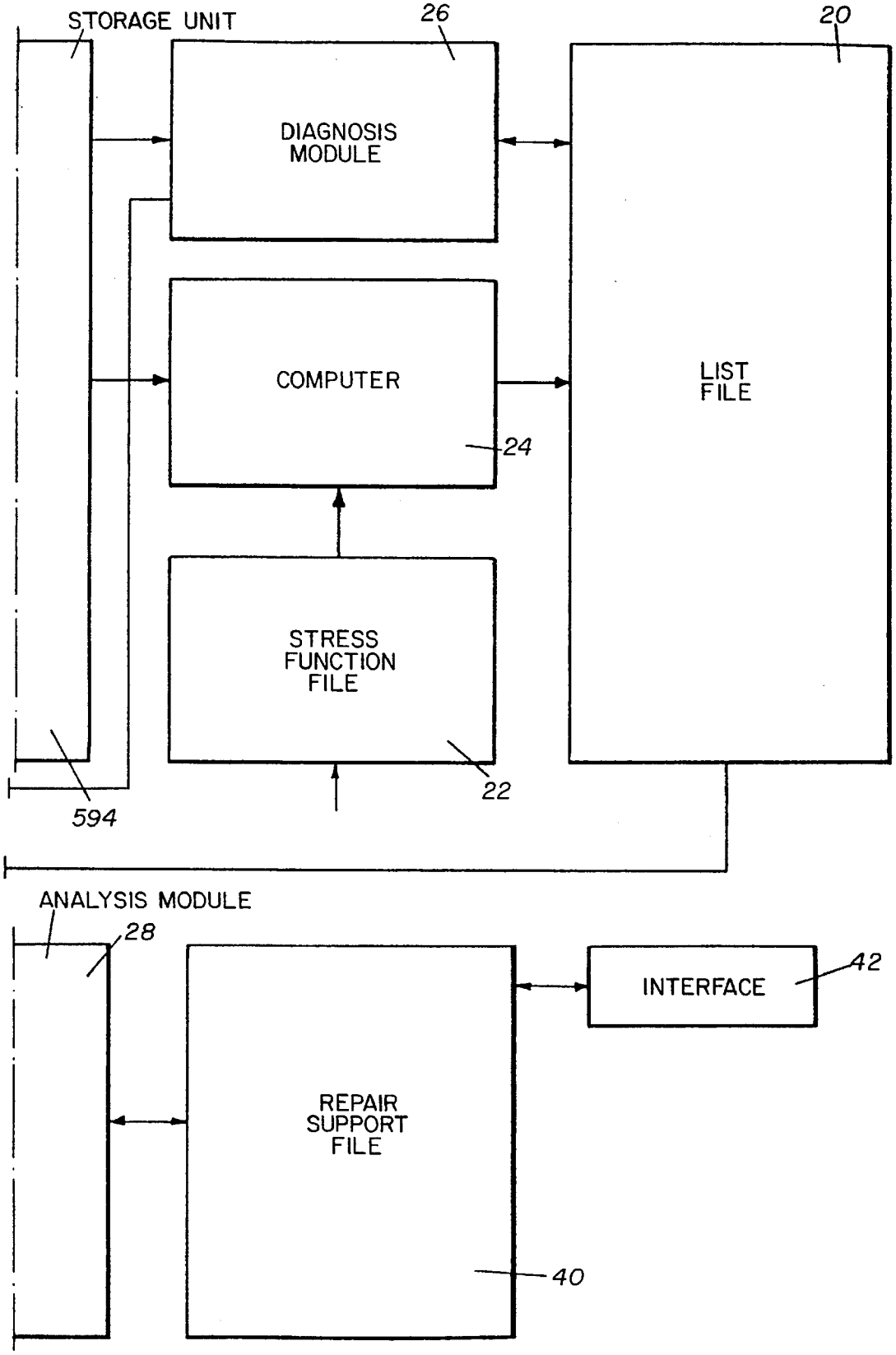

FIGS. 9 and 10 are each a variant embodiment of the system of FIG. 8, where in one case, FIG. 9, a diagnosis function is effected and in the other case, FIG. 10, an analysis function is effected. The information flow is in both cases represented with large "communication paths". The boxes are labeled in order to illustrate the procedure based on examples.

Basic Purposes to the Examples of FIGS. 8 to 10

Study of the entire task of machine management in the spinning mill has shown that in the step from the purely predetermined program controlled preventive maintenance, monitoring and control of unexpected malfunctions are preferably included as well. From this an integrated system for operation support is created which covers the entire maintenance of a machine.

The core of this system relies on the creating of a file of the condition of the most essential components of a machine. It includes as a parameter the longevity of each component under the present working conditions. It simultaneously serves for malfunction diagnosis for unexpected events in that for each component the diagnosis status "okay/questionable/suspicious/defect" is stored.

This data file is preferably updated by a calculation module which calculates each remaining longevity based on fixed preset stress functions.

An expert system program for the malfunction diagnosis is in dialogue with this file as soon as a malfunction appears. The advantage of this combination is that here the diagnosis has access to the current remaining longevity as indication and hence a better success probability and a quicker diagnosis sequences can be expected.

Thirdly, this file is available to an expert system for maintenance. This second expert system continuously tracks the condition of the component and supplies the operator with information concerning upcoming maintenance works. During the course of these works the expert system accepts the operation support in the manner of an electronic maintenance instruction. For this purpose the file "repair support" is at its disposal. The connection of this file via an interface to the spare part ordering system is the logical consequence. it is this support of the expert system "maintenance" with a file for the spare part availability and the preset times for services that enable a reasonable planning ahead of staff and material.

Theoretically, it would be possible to automatically adapt the stress function based on the continuously accumulated operating experiences. This concept however is in conflict with the stress function which may only be changed with great care and while taking into consideration all operational conditions. So, e.g., single defective rolling bearings should not lead to an early replacement of all bearings: such an error must be located to the exact bearing and then repaired. The statistical data of the interventions (file "information"), updated by the operator, supplies immediately the necessary information.

Conditions-Dependent Maintenance

1. Condition of the machine, current/demanded

The condition of a machine is determined by the condition of many single components. Therefore, it can only be acquired in an efficient manner by indirect characteristics. These characteristics include, e.g.:

- unexpected standstills/thread, breakages/sliver, breakages/alarms (detected by machine controls)
- quality values at The exit of the corresponding process stage, e.g., the number of cuts of the yarn cleaner (detected by the Q-sensory mechanism)
- course of the efficiency for the entire machine (calculated by the machine control or the process control system)
- wastage percentage in relation to the material quality at the entrance (see, e.g., WO 92/00409)
- operating expenditure (difficult because it can only be detected indirectly)
- energy consumption
- pressure drop (monitoring criterium for filters, fans and lines)
- dust content in the ambient air
- temperature of critical machine parts
- mechanical vibrations in form of vibrations and noise
- manipulated variables of control circuits, e.g. long-term regulation of the sliver cross section (sensitive indicator for the drifting of important properties: (see e.g. WO 92/00409).

It is now problematical that these few but informative parameters can be evaluated only in connection with a certain production task, i.e., operating parameters. Single parameters even pertain to the spinning plan. Conclusion: the target values and tolerances for these parameters should be stored in a database, each related to a certain production task, (spinning plan, "recipe", process-specification). They can be obtained through extrapolation from similar production tasks and improved as operation experience increases. This breeding of own standards over a long period of time is an important task of works management which is to be supported by the process control system.

Parallel to this condition of the machine there is the condition of single components. It is characterized by the marks left by employment: contamination, aging, material fatigue, corrosion, wear, forceful deformation. The evaluation of the condition requires a diagnosis technique marked by experience and which cannot be automated with sensors and computers. It is now decisive that this quality of machine condition and component condition is taken into consideration in the process control system.

2. Condition Forecast

Present condition of critical components

In classical teaching, a component is allocated a certain wear condition. Departing from the new condition a time or stress dependent course is supposed. From it a forecast is derived and, connected with a certain final condition, also the time for replacement or for maintenance. (Motto: "New condition after last intervention-stress function—future employment condition") for the stress function, time, operating duration and the production volume are known as parameters.

Relationship of Condition Demand—Future Forecasting

In operating practice the condition of the machines is not evaluated based on the single components but on the operating behavior of the machine (see section 1), The planning of the maintenance therefore follows the below sequence:

- Evaluation of the current condition of the machine based on production, quality and operating behavior.
- From this the determination of the condition of single components based on expert knowledge of the user and, if necessary, specific diagnosis.
- Extrapolation of the operating condition based on operational experience, always taking into account the features production, quality and operating behavior.
- Planning of maintenance "to the needed extent", i.e., basically based on condition instead of time.

Deviations from this procedure are made when the condition can be determined only with difficulty and long-term damage must be avoided with preventive behavior: oil change in spindles (when lacking an oil analysis), relubrication of rolling bearings (maintenance is cheaper than checkup).

To retrace these stages the process control system is the suited instrument. It has the calculating capacity for allocating the condition of important components to the behavior of the machine. Furthermore, a database may be set up in it which stores the current condition and its future trend for all important components.

An important aspect of it is the computing method for stress. Until now only models are known which depend linearily on time, operating duration or production. Indeed, stress is strongly non-linear and varies greatly from one component to the next. The following appear as variables;

number of starts: high stress on single parts

Contamination: to a great extent non-linearily dependent on Technology (spinning plan) to a great extent linearily dependent on production (employment duration). Example: bearing of the fluted roller.

mechanical wear of bearing places: as a rule not linearily dependent on the number of actions. Example: cop transport band Wear of technology parts: to a great extent linearily dependent on production. Example: card clothing Forceful damage: Liable to chance. Example: beater set in the cleaning machine.

From this a chart evolves as concept/File on stage process control computer with the most important wear parts, their wear characteristics/stress function and the corresponding extrapolated condition. With critical components the current condition is updated by way of concerted checks (part of maintenance).

"Machine Condition"

The condition of a component should ideally be evaluated within the scope of the "condition of the machine". In order to enable this it is necessary to set up evaluation criteria for the "machine condition". This must take place with the information made available by the sensory mechanism.

For this, preferably a "footprint file" is created which could be e.g. of the following form:

| feature | target value | limit value | actual value / deviation |
|---|---|---|---|
| 1. | | | |
| 2. | | | |
| 3. | | | |
| 4. | | | |
| 5. | | | |
| 6. | | | |
| 7. | | | |
| 8. | | | |

Examples of such "features" are the frequency of malfunctions, quality features of the product, vibration level, power consumption, etc.

Such a file is preferably maintained for every of a number of various "operating conditions", e.g., for various spinning recipes if the corresponding machine conditions essentially differ from each other.

Such a "footprint file" can, e.g., be provided as element of the file 594 (FIG. 3 and FIG. 8).

For each feature it is also normal practice to effect a comparison of the actual value with a limit value or with a target value and to determine deviations from the target value. The footprint file also enables such a procedure and when exceeding a limit value, or when determining an inadmissible deviations, an alarm can be set off or turned off. In this respect the footprint file contains nothing more than a collection of monitored parameters with their respective parameters.

However, in combination with an appropriate evaluation program the footprint file enables the desired evaluation of the "machine condition". This can take place according to a known method (e.g. calculating the root of the sum of the squared value for selected parameters, e.g., $$y=\sqrt{X^2.+x2^2+X3^2\ldots Xn^2)}$$

to take a number of factors into consideration. The essential parameters can comprise actual values as well as deviations. The results of the evaluation are then made available to the analysis module 28 or to the diagnosis module 26.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A textile spinning machine management system having means for sensing an instantaneous operating condition of at least one of a plurality of components of a spinning machine, means connected to the means for sensing for recording and storing a representation of the sensed operating condition in a digital data acquisition file, and means for manipulating the stored data according to a predetermined stress function and means for evaluating the data for performance of preventative maintenance.

2. A system as claimed in claim 1 wherein the data are updated at least intermittently and continuously or quasi-continuously.

3. A system as claimed in claim 2 wherein the data are renewed by means of a calculation program which takes into consideration a preset stress function and preselected operating conditions.

4. A system as claimed in claim 1 wherein the data of the condition file is input to analysis or diagnosis programs which are used for operation support.

5. A system as claimed in claim 4 wherein the analysis program is provided as operation support in maintenance routine by a user of the system.

6. A system as claimed in claim 5 wherein the analysis program has access to a second file which contains instructions for the maintenance routine.

7. A system as claimed in claim 4 wherein the analysis program has access to a file which contains information on the availability of spare parts.

8. A system as claimed in claim 7 wherein the system comprises an interface for communication with a spare part management system.

9. A system as claimed in claim 4 wherein the condition data file and diagnosis or analysis program are contained in a portable computer.

10. A system as claimed in claim 4 wherein the condition data file is contained in a computer for controlling operation of the machine and the diagnosis or analysis program is contained in one of the machine control computer and a portable computer.

11. A system as claimed in claim 4 wherein the machine is controlled by a first computer and the condition data file and the analysis or diagnosis are contained in a second machine-superior control computer connected to the first computer.

12. A system as claimed in claim 4 wherein the diagnosis or analysis program is designed as an expert program.

13. A system as claimed in claim 1 wherein each sensor is connected to an evaluation program which relays signals to the system.

14. A system as claimed in claim 1 including a program for executing a multi-factor analysis of acquired data to determine a parameter which represents a machine condition.

15. A system as claimed in claim 14 wherein a sensor detects an operating condition of the machine which is used for the evaluation of the component conditions.

16. A system as claimed in claim 15 wherein the condition data file is accessible to analysis and diagnosis programs.

17. A machine management system for recording data representative of the operating condition of one or more selected components of a textile spinning machine, the system comprising one or more sensors for detecting a selected operating condition of a component of the spinning machine and a data acquisition file connected to the one or more sensors, the one or more sensors automatically sending a signal indicative of a current operating condition of the component to the data acquisition file, the data acquisition file storing the received signals, the system including means for evaluating the date according to a predetermined stress function.

18. The machine management system of claim 17 wherein the system includes a plurality of said operating condition sensors connected to and sending signals to the data acquisition file, each sensor detecting an operating condition of a different selected component of the machine.

19. The machine management system of claim 17 wherein the one or more sensors detect a component operating condition selected from the group consisting of temperature, vibration, noise, dust content, energy consumption, thread standstills, thread breakages, sliver breakages, sliver standstills, processed fiber quality and percentage of waste of fiber material being processed by the machine.

20. The machine management system of claim 17 wherein the data acquisition file is a file of digital data stored separately in a memory of a computer connected to the one or more sensors.

21. The machine management system of claim 17 wherein the data acquisition file automatically receives signals from the sensors on a predetermined periodic basis.

* * * * *